US005996377A

United States Patent [19]

Cavalli

[11] Patent Number: 5,996,377

[45] Date of Patent: Dec. 7, 1999

[54] DEVICE FOR TENSIONING OF MANUFACTURED ARTICLES IN SINGLE-CYLINDER OR TWO-CYLINDER CIRCULAR STOCKING KNITTING MACHINES

[76] Inventor: Giuseppe Cavalli, Via Giotto 1, Quinzano d'Oglio, Italy

[21] Appl. No.: 09/090,655

[22] Filed: Jun. 4, 1998

[51] Int. Cl.[6] ..... D04B 15/88

[52] U.S. Cl. ..... 66/149 R

[58] Field of Search ..... 66/147, 149 R, 66/150, 151, 152, 153

[56] References Cited

U.S. PATENT DOCUMENTS

| | | | |
|---|---|---|---|
| 2,574,009 | 11/1951 | Belford et al. | 66/149 R |
| 3,214,944 | 11/1965 | Kienel | 66/149 R |
| 3,306,080 | 2/1967 | Rossler | 66/149 R |
| 3,797,280 | 3/1974 | Lonati | 66/149 R |
| 4,945,734 | 8/1990 | Maruyama | 66/149 R |

*Primary Examiner*—John J. Calvert
*Assistant Examiner*—Larry D. Worrell, Jr.
*Attorney, Agent, or Firm*—McGlew and Tuttle, P.C.

[57] ABSTRACT

A device for the drawing of a knitted article in a circular stocking knitting machine. The device includes a tubular element (14), which extends coaxially and rotates with the cylinder of the machine, but is capable of axial movements between a raised position and a lowered position, and a locking element (15), which is arranged and can be moved independently towards and away from one end of the tubular element and can be moved together with the said tubular element. The locking element (15) engages with the end of the tubular element (14) in order to lock the manufactured article, to draw the latter while it is manufactured and to release it for the purpose of discharging it.

4 Claims, 2 Drawing Sheets

DEVICE FOR TENSIONING OF MANUFACTURED ARTICLES IN SINGLE-CYLINDER OR TWO-CYLINDER CIRCULAR STOCKING KNITTING MACHINES

FIELD OF THE INVENTION

The present invention pertains in general to the field of single-cylinder or two cylinder circular stocking knitting machines and, more specifically, it pertains to a device for the tensioning of manufactured articles, especially stockings, during their manufacture on such machines.

BACKGROUND OF THE INVENTION

Circular stocking knitting machines may be equipped with a drawing device, which is able to take hold of the manufactured article during the manufacturing phase, tensioning it to help its downward movement inside the cylinder. Various devices, either pneumatic, or mechanical, or mixed, are already known for such a use and optionally for the turning inside out of the manufactured articles, once they are finished and discharged from the machine.

One of such devices was the object of a previous patent application of the same applicant. This device essentially comprises two tubular elements having different diameters that are inserted coaxially inside one another, are arranged on the inside of the cylinder of a circular stocking knitting machine, delimit an annular hollow space between them for the passage of the manufactured article being manufactured and form with their upper ends a gripping means for pressing the manufactured article at the entrance of said hollow space. The two tubular elements are adjustable in relation to one another for the phases of pressing and releasing the manufactured article and both together in the cylinder, when they have pressed the manufactured article, and this article must be drawn downwards during its knitting.

The prior-art devices are basically efficient but they do all display some limitation and difficulty when they are used to draw thick or bulky manufactured articles.

SUMMARY AND OBJECTS OF THE INVENTION

The primary object of the present invention is to provide a tensioning device that is able to find a solution to this drawback as well.

Another object of the present invention is to provide a tensioning device, which, in addition to being simple and easily applicable to both single-cylinder and two-cylinder circular stocking knitting machines, is more functional as well as reliable for a safe pressing and drawing of each type of manufactured article regardless of the knitting and of its bulkiness.

According to the invention, a device is provided for the drawing of a knitted article during its manufacture with needles on the cylinder of a circular stocking knitting machine. The device includes a tubular element which extends coaxially in the cylinder, which delimits a conduit for the passage of the article being manufactured, which rotates with the cylinder but is capable of axial movement between a raised position and a lowered position. A locking element is arranged and independently movable towards and away from one end of the tubular element and can be moved together with the tubular element when the tubular element moves from another of the positions. The locking element engages the end of the tubular element when the tubular element is in the positions in order to lock the manufactured article which passes in the conduit, following the movement of the tubular element towards the other position with the progress of the manufacture of the article. The locking element is disengaged from the tubular element in order to release the manufactured article once it is finished.

Greater details of the device shall become more evident from the description given below with reference to a single-cylinder circular machine and to the attached indicative and nonlimiting drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
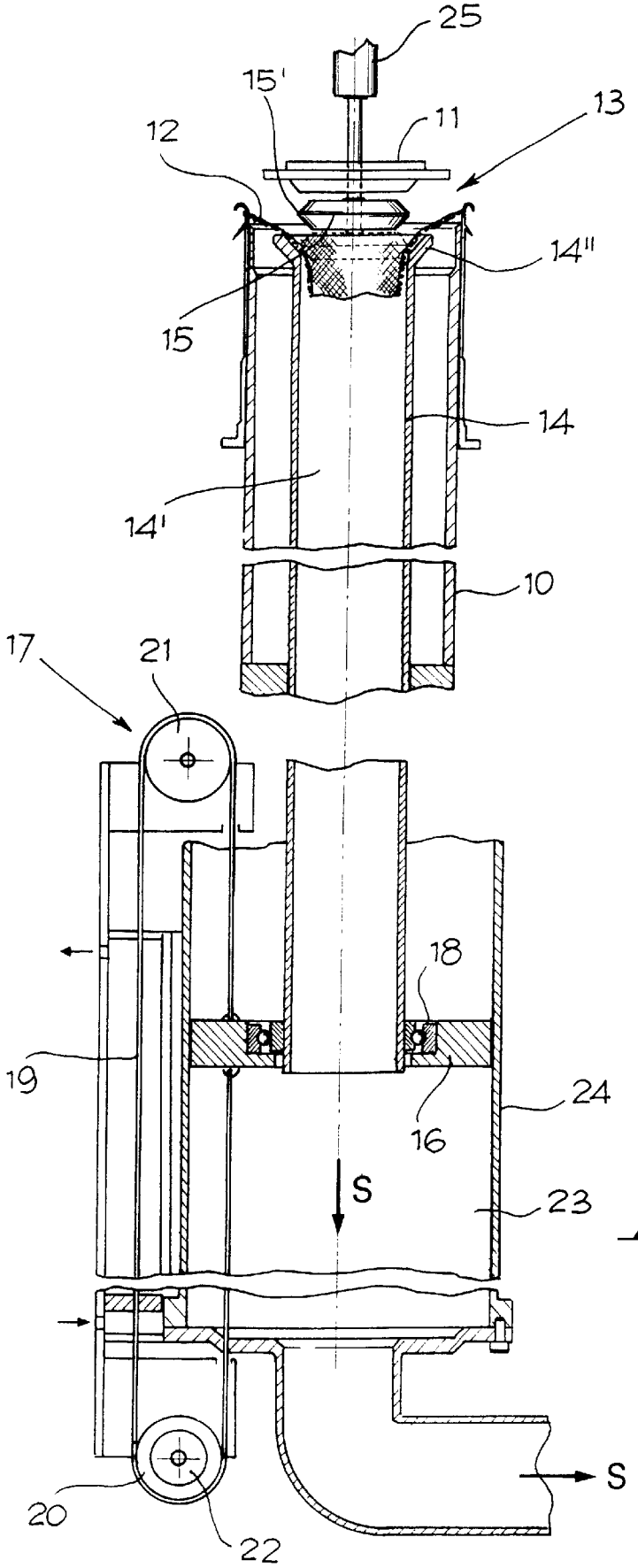
FIG. 1 is an axial sectional view of the cylinder of a circular stocking knitting machine with an associated tensioning device according to the present invention, the device being in the open, i.e., inoperative, position.

Referring to the drawings in particular, a cylinder 10 of a circular stocking knitting machine is surmounted by a disk 11. FIG. 1 shows a knitted article 12 in the manufacturing phase with needles on the cylinder 10 and a device 13 for pressing and tensioning the manufactured article.

This device 13 essentially comprises a tubular element 14, which extends coaxially in the cylinder 10 and a locking element 15 at the tip of the tubular element 14, between this tubular element 14 and the disk 11, when it is a single-cylinder circular machine.

The tubular element 14 delimits a longitudinal conduit 14' for the passage of the article 12 being manufactured. Preferably but not necessarily, it has at its tip a flaring 14" acting as the opening of the manufactured article towards the conduit 14' and intended to interact with the locking element 15.

The tubular element 14 is fixed radially (with suitable means) and rotates with the cylinder 10 , but it is guided and is also capable of axial movements in and with respect to the cylinder 10 between a raised position and lowered position. For its axial movements, the tubular element 14 is fixed at its lower end with a flange 16, and this flange is connected to a linear actuator 17 that is arranged in parallel with the tubular element, below the cylinder 16. A bearing is arranged between the tubular element and the flange, so that the tubular element is able to rotate and the flange is not. The linear actuator 17 may be of a type that is known per se and may comprise, for example, as shown in the drawings, a cable or belt 19 transmitted on two pulleys 20, 21 and with its branch fastened to the flange 16. One of the pulleys is motive or driven and is associated with a control means, e.g., an encoder 22 to measure the longitudinal movement of the tubular element.

Moreover, the said flange 16 at the base of the tubular element 14 may be arranged and slide in a chamber 23 that is delimited by a frame or jacket 24 and connected to a suction source which provides for the evacuation of the finished manufactured article according to the arrow S.

Figure 2:
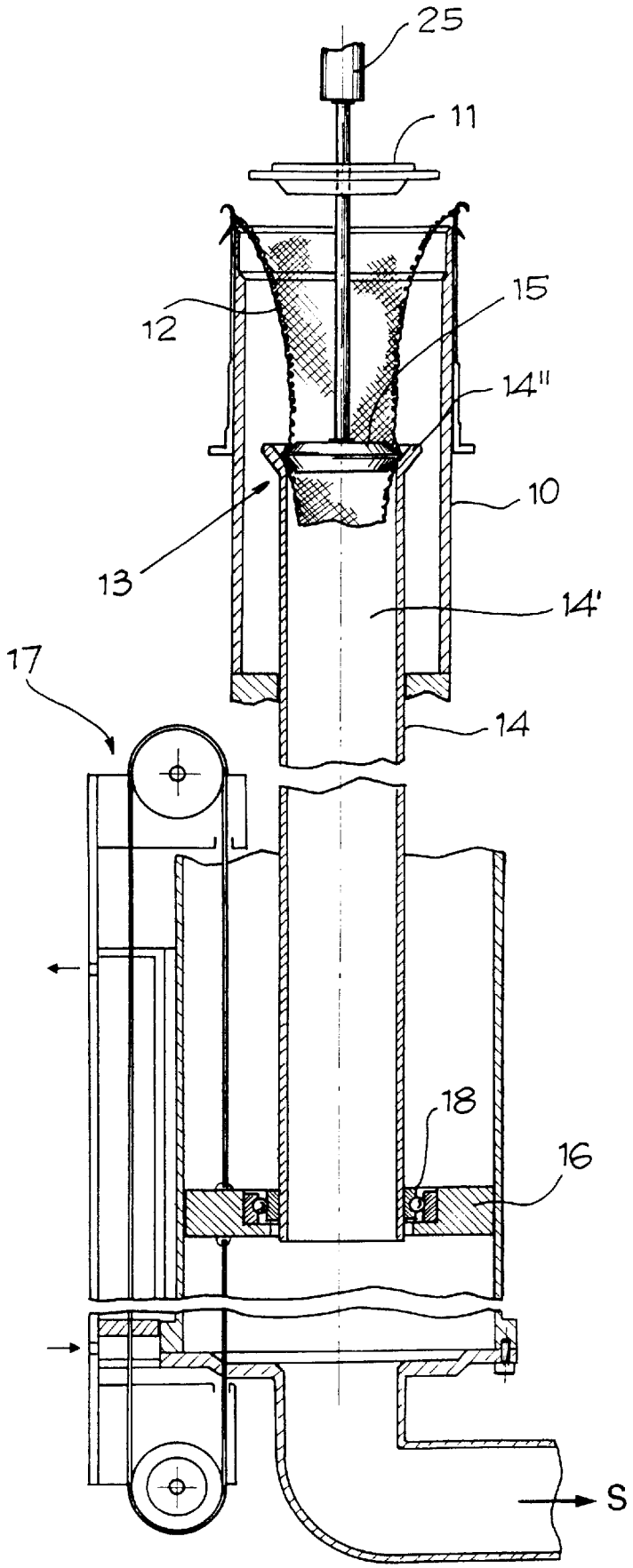
FIG. 2 is a view similar to that of FIG. 1, but with the device closed and in an operating, drawing position.

For its part, the locking element 15 essentially has the shape of a plug, which can be moved towards and away from the tip 14" of the tubular element 14 for the pressing and release, respectively, of the manufactured article, which enters the conduit 14'. For its movements, the locking element 15 is connected and moved with its own electric pneumatic actuator 25, arranged vertically and passing axially to the disk. The locking element 15 has a peripheral margin 15' intended to be joined to the tip 14" of the tubular element 14 in order to lock and hold between them the manufactured article to be subjected to drawing during the manufacture. Once the locking element 15 is resting on the tubular element 14 for the pressing of the manufactured article 12, as is shown in FIG. 2, it remains in this position and follows the longitudinal movements of the tubular element until the manufactured article is finished. Therefore, only the locking element 15 is moved backwards to release the manufactured article, permitting its discharge and evacuation from the bottom according to the arrow S.

In practice, at the beginning of the manufacture of the article 12 (FIG. 1), the tubular element 14 is completely raised, and the locking element 15 is in an inoperative position, away from the tubular element 14.

Then, once the initial part of the manufactured article has been carried out, which enters the conduit 14', the locking element is moved until it rests on the tubular element 14, thus locking the manufactured article. From then, the tubular element and the locking element move concordantly with the progress of the manufacture of the knitted article (FIG. 2) and until the manufactured article is finished. This manufactured article is then released for discharge; the tubular element 14 and the locking element 15 return to the starting position for a new manufactured article.

In case of an application to the two-cylinder machines, the drawing device may be mounted under the lower cylinder or be turned upside down above the upper cylinder depending on whether it is desired to obtain a direct or turned-inside-out discharge of the manufactured article, respectively.

Finally, it must be noted that, by controlling the joint movements of the tubular element and of the locking element, it will be possible to control the width of the knitted article produced and therefore the size of the manufactured article with precision.

While specific embodiments of the invention have been shown and described in detail to illustrate the application of the principles of the invention, it will be understood that the invention may be embodied otherwise without departing from such principles.

What is claimed is:

1. A device for the drawing of a knitted article during its manufacture with needles on a cylinder of a circular stocking knitting machine, the device comprising:

a tubular element extending coaxially in said cylinder, said tubular element delimiting a conduit for passage of the article being manufactured, said tubular element rotating with said cylinder and being axially moveable between a raised position and a lowered position;

a locking element movable towards and away from one end of said tubular element, said locking element being movable together with said tubular element when said tubular element moves between said positions, said locking element engaging said end of said tubular element when said tubular element is in one of said positions in order to lock the article which passes in said conduit, said locking element following movement of said tubular element towards the other position with the progress of the manufacture of the article and being disengaged from said tubular element in order to release the article once said article is finished.

2. The device in accordance with claim 1, wherein:

said tubular element has an end flaring providing an opening for the article towards said conduit; and said locking element has a peripheral margin providing a complementary surface for interacting with said end flaring when said locking element is brought close to said tubular element.

3. The device in accordance with claim 1, further comprising:

a linear actuator for moving said tubular element between said positions, and a locking element actuator for moving said locking element independently of said tubular element and moving said locking element together with said tubular element.

4. The device in accordance with claim 1, wherein:

said locking element is arranged on the knitting machine.

* * * * *